US010124411B2

(12) United States Patent
Beaulieu et al.

(10) Patent No.: US 10,124,411 B2
(45) **Date of Patent: *Nov. 13, 2018**

(54) METHOD FOR PRODUCING POWDER METAL COMPOSITIONS FOR WEAR AND TEMPERATURE RESISTANCE APPLICATIONS AND METHOD OF PRODUCING SAME

(71) Applicants: FEDERAL-MOGUL CORPORATION, Southfield, MI (US); La Corporation de l'Ecole Polytechnique de Montreal, Montreal, Quebec (CA)

(72) Inventors: Philippe Beaulieu, Fond du Lac, WI (US); Denis B. Christopherson, Jr., Waupun, WI (US); Leslie John Farthing, Rugby (GB); Todd Schoenwetter, Waupun, WI (US); Gilles L'Esperance, Candiac (CA)

(73) Assignees: Federal-Mogul LLC, Southfield, MI (US); La Corporation de l'Ecole Polytechnique de Montreal, Montreal (CA)

( * ) Notice: Subject to any disclaimer, the term of this patent is extended or adjusted under 35 U.S.C. 154(b) by 94 days.

This patent is subject to a terminal disclaimer.

(21) Appl. No.: 14/855,883

(22) Filed: Sep. 16, 2015

(65) Prior Publication Data

US 2016/0001369 A1 Jan. 7, 2016

Related U.S. Application Data

(60) Division of application No. 13/837,549, filed on Mar. 15, 2013, now Pat. No. 9,162,285, which is a (Continued)

(51) Int. Cl.
*B22F 9/08* (2006.01)
*B22F 9/04* (2006.01)

(Continued)

(52) U.S. Cl.
CPC ..... *B22F 9/082* (2013.01); *B22F 1/0003* (2013.01); *B22F 3/1017* (2013.01); *B22F 3/12* (2013.01);

(Continued)

(58) Field of Classification Search
CPC ..... B22F 9/082; B22F 1/0003; B22F 3/1017; B22F 9/04; B22F 3/115; B22F 5/02;

(Continued)

(56) References Cited

U.S. PATENT DOCUMENTS 4,315,770 A * 2/1982 Nadkarni ..... C22C 1/1078 75/343
4,576,642 A * 3/1986 Holtz, Jr. ..... B22F 1/0003 419/23

(Continued)

FOREIGN PATENT DOCUMENTS

CN 102286702 A 12/2011
EP 130177 B1 12/1986

(Continued)

*Primary Examiner* — Helene Klemanski
(74) *Attorney, Agent, or Firm* — Robert L. Stearns; Dickinson Wright PLLC

(57) ABSTRACT

A powder metal composition for high wear and temperature applications is made by atomizing a melted iron based alloy including 3.0 to 7.0 wt. % carbon; 10.0 to 25.0 wt. % chromium; 1.0 to 5.0 wt. % tungsten; 3.5 to 7.0 wt. % vanadium; 1.0 to 5.0 wt. % molybdenum; not greater than 0.5 wt. % oxygen; and at least 40.0 wt. % iron. The high carbon content reduces the solubility of oxygen in the melt and thus lowers the oxygen content to a level below which would cause the carbide-forming elements to oxidize during (Continued)

atomization. The powder metal composition includes metal carbides in an amount of at least 15 vol. %. The microhardness of the powder metal composition increases with increasing amounts of carbon and is typically about 800 to 1,500 Hv50.

13 Claims, 2 Drawing Sheets

Related U.S. Application Data continuation-in-part of application No. 12/419,683, filed on Apr. 7, 2009, now Pat. No. 9,546,412.

(60) Provisional application No. 61/043,256, filed on Apr. 8, 2008.

(51) Int. Cl.

| | |
|---|---|
| ***B22F 3/115*** | (2006.01) |
| ***B22F 5/02*** | (2006.01) |
| ***C22C 33/02*** | (2006.01) |
| ***C22C 37/06*** | (2006.01) |
| ***C23C 4/06*** | (2016.01) |
| ***C23C 4/08*** | (2016.01) |
| ***B22F 1/00*** | (2006.01) |
| ***B22F 3/12*** | (2006.01) |
| ***C22C 1/02*** | (2006.01) |
| ***B22F 3/10*** | (2006.01) |
| ***C21D 6/00*** | (2006.01) |
| ***C21D 9/00*** | (2006.01) |

(52) U.S. Cl.
CPC ..... *C21D 6/002* (2013.01); *C21D 9/00* (2013.01); *C22C 1/02* (2013.01); *C22C 33/0285* (2013.01); *C22C 37/06* (2013.01); *B22F 2009/0828* (2013.01); *B22F 2998/10* (2013.01)

(58) Field of Classification Search
CPC ..... C21D 6/002; C23C 4/06; C23C 4/065; C23C 4/08; C22C 33/0228; C22C 33/0285; C22C 37/06
USPC ..... 75/255, 246, 338; 420/12; 427/456
See application file for complete search history.

(56) References Cited

U.S. PATENT DOCUMENTS

| | | | | |
|---|---|---|---|---|
| 5,069,867 | A * | 12/1991 | Zengin | C22C 33/0207 419/15 |
| 6,887,585 | B2 | 5/2005 | Herbst-Dederichs | |
| 9,162,285 | B2 * | 10/2015 | Christopherson, Jr. | C22C 33/0285 |
| 9,546,412 | B2 * | 1/2017 | Christopherson, Jr. | B22F 9/082 |
| 9,624,568 | B2 * | 4/2017 | Christopherson, Jr. | C23C 4/08 |
| 2009/0252636 | A1 | 10/2009 | Christopherson, Jr. et al. | |

FOREIGN PATENT DOCUMENTS

| | | | |
|---|---|---|---|
| EP | 0266149 | A2 | 5/1988 |
| EP | 0625392 | A1 | 11/1994 |
| EP | 0813617 | A1 | 12/1997 |
| JP | S5550404 | A | 4/1980 |
| JP | S63213601 | A | 9/1988 |
| JP | H0266139 | A | 3/1990 |
| JP | H02175847 | A | 7/1990 |
| JP | 2003055747 | A | 2/2003 |
| JP | 2006159269 | A | 6/2006 |
| WO | 2008036026 | A1 | 3/2008 |

* cited by examiner

METHOD FOR PRODUCING POWDER METAL COMPOSITIONS FOR WEAR AND TEMPERATURE RESISTANCE APPLICATIONS AND METHOD OF PRODUCING SAME

This application is a Divisional and claims the benefit of U.S. Continuation-in-Part U.S. Pat. No. 9,162,285 issued Oct. 20, 2015, which claims the benefit of U.S. Utility Pat. No. 9,546,412 issued Jan. 17, 2017, which claims priority to U.S. Provisional Application Ser. No. 61/043,256, filed Apr. 8, 2008, the contents of which are incorporated herein by reference in their entirety.

TECHNICAL FIELD

This invention relates generally to a powder metal composition, and methods of producing the powder metal composition from an iron based alloy.

BACKGROUND OF THE INVENTION

High hardness prealloyed iron based powder, such as tool steel grade of powders, can either be used alone or admixed with other powder metal compositions in the powder-metallurgy production of various articles of manufacture. Tool steels contain elements such as chromium, vanadium, molybdenum and tungsten which combine with carbon to form various carbides such as $M_6C$, MC, $M_3C$, $M_7C_3$, $M_{23}C_6$. These carbides are very hard and contribute to the wear resistance of tool steels.

The use of powder metal processing permits particles to be formed from fully alloyed molten metal, such that each particle possesses the fully alloyed chemical composition of the molten batch of metal. The powder metal process also permits rapid solidification of the molten metal into the small particles which eliminates macro segregation normally associated with ingot casting. In the case of highly alloyed steels, such as tool steel, a uniform distribution of carbides can be developed within each particle, making for a very hard and wear resistant powder material.

It is common to create the powder through atomization. In the case of tool steels and other alloys containing high levels of chromium and/or vanadium which are highly prone to oxidation, gas atomization is often used, wherein a stream of the molten alloy is poured through a nozzle into a protective chamber and impacted by a flow of high-pressure inert gas such as nitrogen which disperses the molten metal stream into droplets. The inert gas protects the alloying elements from oxidizing during atomization and the gas-atomized powder has a characteristic smooth, rounded shape.

Water atomization is also commonly used to produce powder metal. It is similar to gas atomization, except that high-pressure water is used in place of nitrogen gas as the atomizing fluid. Water can be a more effective quenching medium, so that the solidification rates can be higher as compared to conventional gas atomization. Water-atomized particles typically have a more irregular shape which can be more desirable during subsequent compaction of the powder to achieve a greater green strength of powder metal compacts. However, in the case of tool steels and other steels containing high levels of chromium and/or vanadium, the use of water as the atomizing fluid would cause the alloying elements to oxidize during atomization and tie these alloying elements up making them unavailable for reaction with carbon to form carbides. Consequently, if water atomization were employed, it may need to be followed up by a separate oxide reduction and/or annealing cycle, where the powder is heated and held at an elevated temperature for a lengthy period of time (on the order of several hours or days) and in the presence of a reducing agent such as powdered graphite, or other source of carbon or other reducing agent or by another reducing process. The carbon of the graphite would combine with the oxygen to free up the alloying elements so that they would be available for carbide formation during the subsequent sintering and tempering stages following consolidation of the powder into green compacts. It will be appreciated that the requirement for the extra annealing/reducing step and the addition of graphite powder adds cost and complexity to the formation of high alloy powders via the water atomization process.

SUMMARY OF THE INVENTION

One aspect of the invention provides a method of producing a powder metal composition, comprising the steps of: providing a melted iron based alloy including 3.0 to 7.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, not greater than 0.5 wt. % oxygen, and at least 40.0 wt. % iron; and atomizing the melted iron based alloy to provide atomized droplets of the iron based alloy.

Another aspect of the invention provides a method of producing a sintered article, comprising the steps of: providing a melted iron based alloy including 3.0 to 7.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, not greater than 0.5 wt. % oxygen, and at least 40.0 wt. % iron; atomizing the melted iron based alloy to provide atomized droplets of the iron based alloy, referred to as a powder metal composition. The method next includes mixing the powder metal composition with another powder metal; compacting the mixture to form a preform; and sintering the preform.

Another aspect of the invention provides a powder metal composition, comprising: 3.0 to 7.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, not greater than 0.5 wt. % oxygen, and at least 40.0 wt. % iron, based on the total weight of the powder metal composition.

Another aspect of the invention provides a sintered powder metal composition, comprising: 3.0 to 7.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, not greater than 0.5 wt. % oxygen, and at least 40.0 wt. % iron, based on the total weight of the sintered powder metal composition.

BRIEF DESCRIPTION OF THE DRAWINGS

These and other features and advantages of the invention will become more apparent to those skilled in the art from the detailed description and accompanying drawing which schematically illustrates the process used to produce the powder.

DETAILED DESCRIPTION

Figure 1:
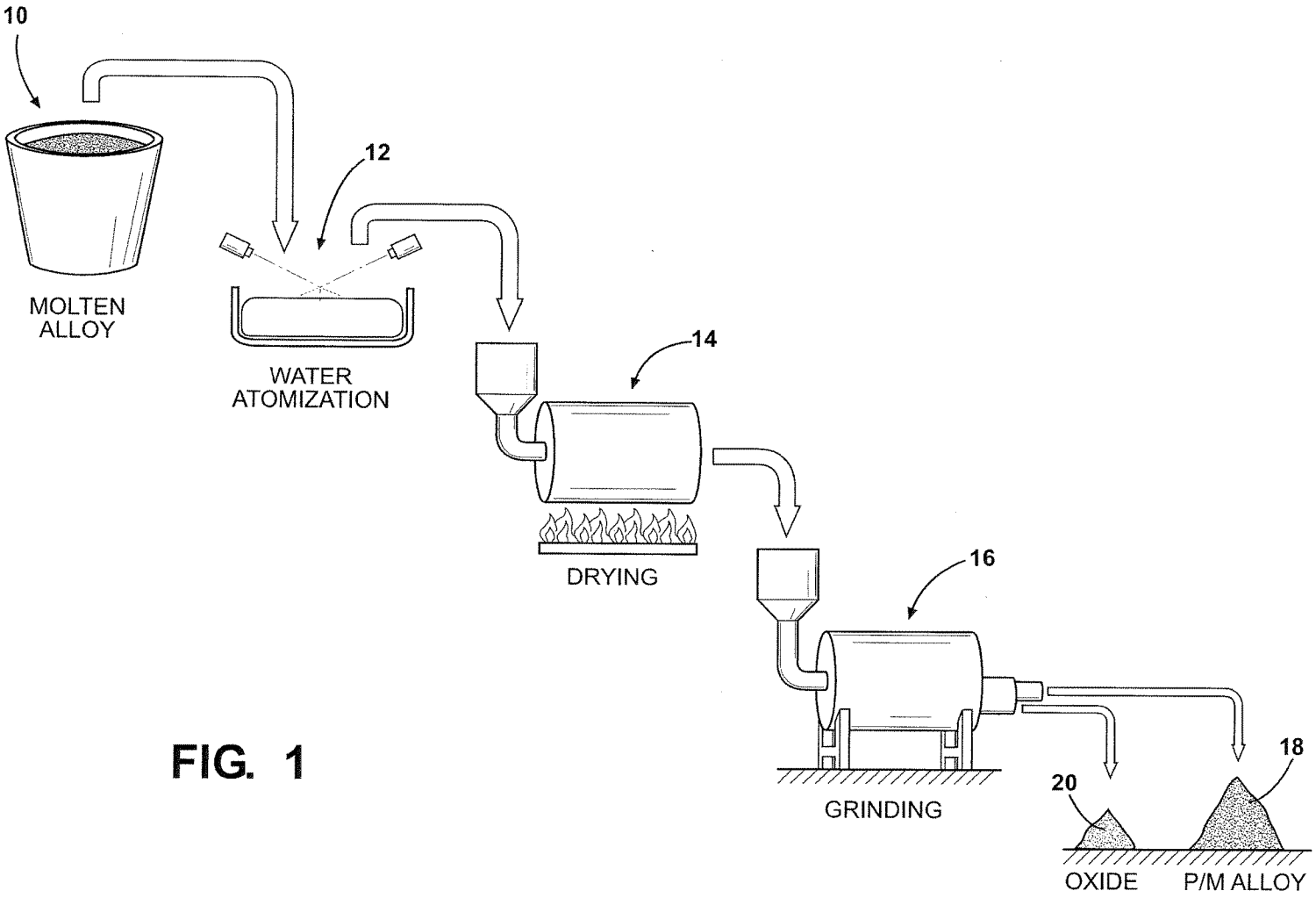
FIG. 1 is a schematic drawing of a process for producing a powder metal composition.

A process for producing high carbon, iron based alloy powder, also referred to as a pre-sintered powder metal composition, is schematically illustrated in FIG. 1. The powder metal composition is inexpensively produced and has an elevated hardness that is believed to be above that typically achieved by either gas or conventional water atomization processes with comparable alloy compositions having lower carbon levels.

The process first includes preparing a batch 10 of an iron based alloy. The iron based alloy is fully alloyed with carbide-forming elements, including chromium (Cr), molybdenum (Mo), tungsten (W), and vanadium (V). The iron based alloy is melted and then fed to an atomizer 12. In the embodiment of FIG. 1, the atomizer is a water atomizer 12, but could alternatively be a gas atomizer. Some properties can be improved using gas atomization over water atomization, for example better flow, apparent density, and lower oxygen content. In addition, the gas atomization provides droplets having a generally round shape.

In water atomization step of FIG. 1, a stream of the molten batch 10 is impacted by a flow of high-pressure water which disperses and rapidly solidifies the molten stream into fully alloyed metal droplets or particles of irregular shape. The outer surface of the metal particles may become oxidized due to exposure to the water and unprotected atmosphere. The atomized particles are passed through a dryer 14 and then onto a grinder 16 where the particles are mechanically ground or crushed. A ball mill or other mechanical reducing device may be employed. If an oxide skin is formed on the atomized droplets, the mechanical grinding of the particles fractures and separates the outer oxide skin from the particles, and the ground particles are then separated from the oxide to yield an atomized powder metal composition 18 and oxide particles 20. The power metal particles and/or oxide particles may also fracture and thus be reduced in size. The powder metal composition 18 may be further sorted for size, shape and other characteristics normally associated with powder metal.

The batch 10 of the iron based alloy provided for atomization has a high carbon content. In one embodiment, the iron based alloy includes at least 3.0 wt. % carbon, or 3.0 to 7.0 wt. % carbon, or 3.5 to 4.0 wt. % carbon, and preferably about 3.8 wt. % carbon, based on the total weight of the iron based alloy. The amount of carbon present in the iron based alloy depends on the amount and composition of the carbide-forming elements. However, the carbon is preferably present in an amount sufficient to form metal carbides during the atomization process in an amount greater than 15 vol. %, based on the total volume of the powder metal composition 18.

Another reason for adding the excess carbon to the iron based alloy is to protect the iron based alloy from oxidizing during the melting and atomization steps. The increased amount of carbon decreases the solubility of oxygen in the melted iron based alloy. The amount of carbon also ensures that the matrix in which the carbides precipitates reside is one of essentially austenite and/or martensite, particularly when the levels of Cr and/or V are high.

The "low" oxygen content is an amount not greater than 0.5 wt. %, based on the total weight of the iron based alloy. In one embodiment, the oxygen content is not greater than 0.3 wt. %, for example 0.2 wt. %. Depleting the oxygen level in the melt has the benefit of shielding the carbide-forming alloy elements, such as chromium (Cr), molybdenum (Mo), tungsten (W), and vanadium (V), from oxidizing during the melting or atomization steps, and thus being free to combine with the carbon to form carbides.

The chromium (Cr), molybdenum (Mo), tungsten (W), and vanadium (V) of the iron based alloy are also present in amounts sufficient to form the metal carbides in an amount of at least 15.0 vol. %, based on the total volume of the powder metal composition 18. For cost reasons, there is also desire to increase the amount of some of the carbide-forming alloy elements over others. Thus, while Mo is an excellent choice for forming very hard carbides with a high carbide density, it is presently very costly as compared, to say, Cr. To develop a low cost tool grade quality of steel that is at least comparable in performance to a more costly and conventional M2 grade of tool steel, the iron based alloy can include a relatively high level of Cr, lower level of Mo, and increased amount of C. The amount of W and V can vary depending upon the desired amount of carbides to be formed. Increasing the amount of carbide forming alloying elements in the iron based alloy can also increase the amount of carbides formed in the matrix during the atomizing step. In addition, the Cr, Mo, W, and V are preferably present in amounts sufficient to provide exceptional wear resistance at a reduced cost, compared to other powder metal compositions.

In one embodiment, the iron based alloy includes 10.0 to 25.0 wt. % chromium, preferably 11.0 to 15.0 wt. % chromium, and most preferably 13.0 wt. % chromium; 1.0 to 5.0 wt. % tungsten, preferably 1.5 to 3.5 wt. % tungsten, and most preferably 2.5 wt. % tungsten; 3.5 to 7.0 wt. % vanadium, preferably 4.0 to 6.5 wt. % vanadium, and most preferably 6.0 wt. % vanadium; 1.0 to 5.0 wt. % molybdenum, preferably 1.0 to 3.0 wt. % molybdenum, and most preferably 1.5 wt. % molybdenum.

The iron based alloy can optionally include other elements, which may contribute to improved wear resistance or enhance another material characteristic. For example, the iron based alloy can include at least one of cobalt (Co), niobium (Nb) titanium (Ti), manganese (Mn), sulfur (S), silicon (Si), phosphorous (P), zirconium (Zr), and tantalum (Ta). In one embodiment, the iron based alloy includes at least one of the following: 4.0 to 15.0 wt. % cobalt; up to 7.0 wt. % niobium; up to 7.0 wt. % titanium; up to 2.0 wt. % manganese; up to 1.15 wt. % sulfur; up to 2.0 wt. % silicon; up to 2.0 wt. % phosphorous; up to 2.0 wt. % zirconium; and up to 2.0 wt. % tantalum. In one embodiment, the iron based alloy contains pre alloyed sulfur to form sulfides or sulfur containing compounds in the powder. Sulfides, for example MnS and CrS, are known to improve machinability and could be beneficial to wear resistance.

The remaining balance of the iron based alloy provided for atomization is iron. In one embodiment, the iron based alloy includes at least 40.0 wt. % iron, or 50.0 to 81.5 wt% iron, and preferably 70.0 to 80.0 wt. % iron.

If the atomization process is a water atomization process, a stream of the melted iron based alloy is impacted by a flow of high-pressure water which disperses and rapidly solidifies the melted iron based alloy stream into fully alloyed metal droplets of irregular shape. Preferably, each atomized droplet possesses the full iron based alloy composition, including 3.0 to 7.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, and at least 40.0 wt. % iron. The outside surface of the droplets may become oxidized due to exposure to the water and unprotected atmosphere. However, the high carbon content and low oxygen content considerably limits the oxidization during the atomizing step.

In the as-atomized state, the carbide-forming alloys may be present in a super saturated state due to the rapid solidification that occurs during atomization (ex. vanadium). The unoxidized super saturated state of the alloying elements combined with the high carbon content allows carbides (ex. $M_8C_7$ V-rich carbides) to precipitate and fully develop very quickly (within minutes) during the subsequent sintering stage without the need for an extended prior annealing cycle (hours or days). The nanometric carbides present in the as-atomized powders grow to a micrometric size after sintering. However, the powder metal composition 18 can be annealed if desired, for example, from 1 to 48 hours at temperatures of about 900-1100° C., or according to other annealing cycles if desired. The annealing can be carried out both before grinding and after grinding the powder metal composition 18. It is understood that annealing is not mandatory, but is optional.

The atomized droplets are then passed through a dryer and into a grinder where they are mechanically ground or crushed to remove the oxide skin, and then sieved. Even if little or no oxide skin is present, the mechanical grinding step may also be used to fracture and reduce the size of the powder metal droplets. The hard and very fine nano-structure of the droplets improves the ease of grinding. A ball mill or other mechanical size reducing device may be employed. If an outer oxide skin is formed on the atomized droplets during the atomization step, which typically occurs during water atomization, the mechanical grinding fractures and separates the outer oxide skin from the bulk of the droplets. The ground droplets are separated from the oxide skin to yield the powder metal composition 18 and oxide particles 20. However, the carbide-forming elements of the droplets are protected from oxidation by the high carbon content during the melting and atomizing steps. The pre-sintered powder metal composition 18 may be further sorted for size, shape and other characteristics normally associated with powder metal. In certain cases, such as when gas atomization is used, the outer oxide skin is minimal and can be part of the powder metal composition and tolerated without removal, thus making grinding optional in some cases for at least the purpose of breaking the outer oxide layer. However, the grinding can still be used to reduce the size of the powder metal composition.

The composition, in wt. %, of the pre-sintered powder metal composition 18 is the same as the composition of the iron based alloy described above, prior to melting and atomization. The powder metal composition 18 typically includes 10.0 to 25.0 wt. % chromium, preferably 11.0 to 15.0 wt. % chromium, and most preferably 13.0 wt. % chromium; 1.0 to 5.0 wt. % tungsten, preferably 1.5 to 3.5 wt. % tungsten, and most preferably 2.5 wt. % tungsten; 3.5 to 7.0 wt. % vanadium, preferably 4.0 to 6.5 wt. % vanadium, and most preferably 6.0 wt. % vanadium; 1.0 to 5.0 wt. % molybdenum, preferably 1.0 to 3.0 wt. % molybdenum, and most preferably 1.5 wt. % molybdenum.

The powder metal composition 18 also includes at least 3.0 wt. % carbon, or 3.0 to 7.0 wt. % carbon, or 3.5 to 4.0 wt. % carbon, and preferably about 3.8 wt. % carbon. The carbon is present in an amount sufficient to provide metal carbides in an amount of at least 15 vol. %, based on the total volume of the powder metal composition 18.

As the amount of carbon in the powder metal composition 18 increases so does the hardness of the powder metal composition 18. This is because greater amounts of carbon form greater amounts of carbides during the atomization step, which increases the hardness. The amount of carbon in the powder metal composition 18 is referred to as carbon total ($C_{tot}$).

The powder metal composition 18 also includes a stoichiometric amount of carbon ($C_{stoich}$), which represents the total carbon content that is tied up in the alloyed carbides at equilibrium. The type and composition of the carbides vary as a function of the carbon content and of the alloying elements content.

The $C_{stoich}$ necessary to form the desired amount of metal carbides during atomization depends on the amount of carbide-forming elements present in the powder metal composition 18. The $C_{stoich}$ for a particular composition is obtained by multiplying the amount of each carbide-forming element by a multiplying factor specific to each element. For a particular carbide-forming element, the multiplying factor is equal to the amount of carbon required to precipitate 1 wt. % of that particular carbide-forming element. The multiplying factors vary based on the type of precipitates formed, the amount of carbon, and the amount of each of the alloying elements. The multiplying factor for a specific carbide will also vary with the amount of carbon and the amount of the alloying elements.

For example, to form precipitates of $(Cr_{23.5}Fe_{7.3}V_{63.1}Mo_{3.2}W_{2.9})_8C_7$, also referred to as $M_8C_7$, in the powder metal composition 18, the multiplying factors of the carbide-forming elements are calculated as follows. First, the atomic ratio of the $M_8C_7$ carbide is determined: 1.88 atoms of Cr, 0.58 atoms of Fe, 5.05 atoms of V, 0.26 atoms of Mo, 0.23 atoms of W, and 7 atoms of C. Next, the mass of each element per one mole of the $M_8C_7$ carbide is determined: V=257.15 grams, Cr=97.76 grams, Fe=32.62 grams, Mo=24.56 grams, W=42.65 grams, and C=84.07 grams. The weight ratio of each carbide-forming element is then determined: V=47.73 wt. %, Cr=18.14 wt. %, Fe=6.05 wt. %, Mo=4.56 wt. %, W=7.92 wt. %, and C=15.60 wt. %. The weight ratio indicates 47.73 grams of V will react with 15.60 grams of C, which means 1 gram of V will react with 0.33 grams of C. To precipitate 1.0 wt. % V in the $M_8C_7$ carbide you need 0.33 wt. % carbon, and therefore the multiplying factor for V is 0.33. The same calculation is done to determine the multiplying factor for Cr=0.29, Mo=0.06, and W=0.03.

The $C_{stoich}$ in the powder metal composition 18 is next determined by multiplying the amount of each carbide-forming element by the associated multiplying factor, and then adding each of those values together. For example, if the powder metal composition 18 includes 4.0 wt. % V, 13.0 wt. % Cr, 1.5 wt. % Mo, and 2.5 wt. % W, then $C_{stoich}$=(4.0*0.33)+(13.0*0.29)+(1.5*0.06)+(2.5*0.03)=5.26 wt. %.

In addition, the powder metal composition 18 includes a $C_{tot}/C_{stoich}$ amount less than 1.1. Therefore, when the powder metal composition 18 includes carbon at the upper limit of 7.0 wt. %, the $C_{stoich}$ will be equal to or less than 6.36 wt. % carbon. The $C_{tot}/C_{stoich}$ ratio will vary depending on the amount of alloying elements for a fixed carbon content, but the $C_{tot}/C_{stoich}$ ratio will remain less than 1.1.

Table 1 below provides examples of other carbide types that can be found in the powder metal composition 18, and multiplying factors for Cr, V, Mo, and W for generic carbide stoichiometry. However, the metal atoms in each of the carbides listed in the table could be partly replaced by other atoms, which would affect the multiplying factors.

TABLE 1

| Element | Carbide type | Example of stoichiometry | Multiplying factor $f_M$ (w %/w %) |
|---|---|---|---|
| Cr | $M_7C_3$ | $Cr_{3.5}Fe_{3.5}C_3$ | 0.20 |
| | | $Cr_4Fe_3C_3$ | 0.17 |
| | | $(Cr_{34}Fe_{66})_7C_3$ | 0.29 |

TABLE 1-continued

| Element | Carbide type | Example of stoichiometry | Multiplying factor $f_M$ (w %/w %) |
|---|---|---|---|
| V | $M_8C_7$ | $(V_{63}Fe_{37})_8C_7$ | 0.33 |
| Mo | $M_6C$ | $Mo_3Fe_3C$ | 0.04 |
| | | $Mo_2Fe_4C$ | 0.06 |
| W | $M_6C$ | $W_3Fe_3C$ | 0.02 |
| | | $W_2Fe_4C$ | 0.03 |

The metal carbides are formed during the atomization process and are present in an amount of at least 15.0 vol. %, but preferably in an amount of 40.0 to 60.0 vol. %, or 47.0 to 52.0 vol. %, and typically about 50.0 vol. %. In one embodiment, the powder metal composition 18 includes chromium-rich carbides, molybdenum-rich carbides, tungsten-rich carbides and vanadium-rich carbides in a total amount of about 50.0 vol. %.

The metal carbides have a nanoscale microstructure. In one embodiment, the metal carbides have a diameter between 1 and 400 nanometers. As alluded to above, the carbides can be of various types, including $M_8C_7$, $M_7C_3$, MC, $M_6C$, $M_{23}C_6$, and $M_3C$, wherein M is at least one metal atom, such as Fe, Cr, V, Mo, and/or W, and C is carbon. In one embodiment, the metal carbides are selected from the group consisting of: $M_8C_7$, $M_7C_3$, $M_6C$; wherein $M_8C_7$ is $(V_{63}Fe_{37})_8C_7$, $M_7C_3$ is selected from the group consisting of: $(Cr_{34}Fe_{66})_7C_3$, $Cr_{35}Fe_{35}C_3$, and $Cr_4Fe_3C_3$; and $M_6C$ is selected from the group consisting of: $Mo_3Fe_3C$, $Mo_2Fe_4C$, $W_3Fe_3C$, and $W_2Fe_4C$. The microstructure of the powder metal composition 18 also includes nanoscale austenite, and may include nanoscale martensite, along with the nanoscale carbides.

In one embodiment, the powder metal composition 18 consists essentially of 3.0 to 7.0 wt. % carbon; 10.0 to 25.0 wt. % chromium; 1.0 to 5.0 wt. % tungsten; 3.5 to 7.0 wt. % vanadium; 1.0 to 5.0 wt. % molybdenum; not greater than 0.5 wt. % oxygen; a balance of iron, and incidental impurities in an amount not greater than 5.0 wt. %, preferably not greater than 2.0 wt. %. However, the powder metal composition 18 can optionally include other elements, which may enhance material characteristics. In one embodiment, the powder metal composition includes at least one of cobalt, niobium, titanium, manganese, sulfur, silicon, phosphorous, zirconium, and tantalum. For example, the iron based alloy can include at least one of 4.0 to 15.0 wt. % cobalt; up to 7.0 wt. % niobium; up to 7.0 wt. % titanium; up to 2.0 wt. % manganese; up to 1.15 wt. % sulfur; up to 2.0 wt. % silicon; up to 2.0 wt. % phosphorous; up to 2.0 wt. % zirconium; and up to 2.0 wt. % tantalum. In one embodiment, the powder metal composition 18 contains pre alloyed sulfur to form sulfides or sulfur containing compounds in the powder. Sulfides, for example MnS and CrS, are known to improve machinability and could be beneficial to wear resistance.

The remaining balance of the powder metal composition 18 is iron. In one embodiment, the powder metal composition includes at least 40.0 wt. % iron, or 50.0 to 81.5 wt. % iron, and preferably 70.0 to 80.0 wt. % iron. The powder metal composition has a melting point of about 1,235° C. (2,255° F.). It will be completely melted at about 1,235° C. (2,255° F.), but may include a small fraction of a liquid phase at a temperature as low as 1,150° C. The melting point of the powder metal composition 18 will vary as a function of the carbon content and alloying element content.

Figure 2:
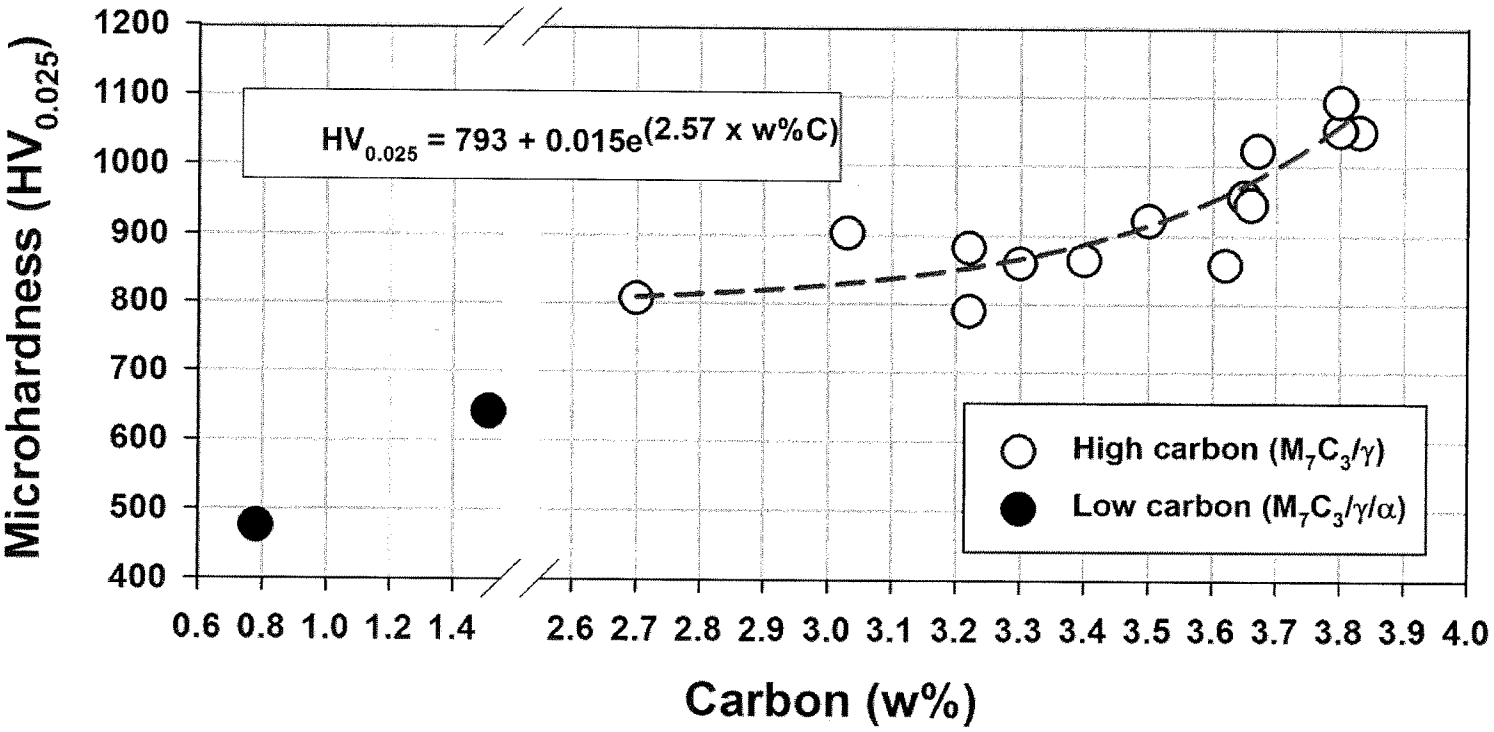
FIG. 2 is a graph illustrating hardness v. carbon content.

The powder metal composition 18 typically has a microhardness of 800 to 1,500 Hv50. FIG. 2 illustrates the hardness of the powder metal composition without annealing compared to the carbon content, and indicates the hardness increases with increasing amounts of carbon. Table 2 below also provides the hardness values for varying amounts of carbon, both before and after annealing, when the powder metal composition includes 13.0 wt. % chromium, 2.5 wt. % tungsten, 6.0 wt. % vanadium, 1.5 wt. % molybdenum, 0.2 wt. % oxygen, 70.0 to 80.0 wt. % iron, and impurities in an amount not greater than 2.0 wt. %. The data shows that the hardness of the powder metal composition increases with increasing amounts of carbon, both without annealing and after annealing. It should be noted that the amount of carbon content is the amount before annealing. The carbon content may decrease slightly during annealing, for example it may decrease up to 0.15 wt. %. However, the hardness values still increase with increasing amounts of carbon.

TABLE 2

| Carbon Content (wt. %) | Hardness Before Annealing | Hardness After Annealing |
|---|---|---|
| 3.66% | 975 HV0.025 | 450 HV0.025 |
| 3.03% | 900 HV0.025 | 407 HV0.025 |
| 2.70% | 810 HV0.025 | 382 HV0.025 |

The hardness can be essentially maintained through sintering and tempering, although some of the excess carbon contained in the powder metal composition above that needed to develop the carbides may diffuse out of the hard powder metal composition if admixed with another ferrous powder composition having a lower carbon content. This excess carbon diffusion has the added benefit of eliminating or at least decreasing the need for additions of carbon-rich powders (e.g., powdered graphite) that is sometimes added during compaction and sintering for control of microstructure and property enhancement. In addition, prealloyed carbon will reduce the tendency for graphite segregation which can occur with separate graphite additions.

The powder metal composition 18 is typically compacted and sintered to form an article that can be used in various applications, particularly automotive components. Prior to sintering, the powder metal composition 18 is preferably admixed with another powder metal or a mixture of other powder metals. The other powder metals can include unalloyed, low alloyed, or alloyed steel powder, as well as non-ferrous powder. In addition, small amounts of other metals or components could be present in the mixture.

In one embodiment, the mixture includes 10.0 to 40.0 wt. % of the powder metal composition 18, and preferably at least 20.0 wt. % of the powder metal composition 18. The mixture also includes 30.0 to 90.0 wt. %, of the other powder metal, but typically includes about 60.0 to 80.0 wt. % of the other powder metal. Next, the mixture is compacted and then sintered.

The high carbon powder metal composition can be annealed prior to sintering. Annealing increases the compressibility of the powder metal composition 18 thereby allowing more of the powder metal composition 18 to be used in the mixture, or to press to higher green density. The amount of powder metal composition 18 in the mixture can be increased to amounts greater than 40.0 wt. %, for example up to 60.0 wt. %, when the powder metal composition 18 is annealed. However, thermal processing, such as extended annealing or oxide reduction, of the powder metal material is not required prior to sintering, as is necessary with other powder metal compositions with low carbon levels to reduce oxygen and produce the appropriate microstructure.

The sintered powder metal composition preferably includes the metal carbides finely and uniformly distributed throughout the powder metal composition. If 100% of the sintered composition is formed with the powder metal composition 18, then the metal carbides are present in the sintered powder metal composition in an amount of at least 15 vol. %, and preferably 40.0 to 60.0 vol. %, or 47.0 to 52.0 vol. %, and typically about 50.0 vol. %. In one embodiment, the sintered powder metal composition includes chromium-rich carbides, molybdenum-rich carbides, tungsten-rich carbides, and vanadium-rich carbides in a total amount of about 50.0 vol. %. In another embodiment, the sintered powder metal composition includes the vanadium-rich carbides in an amount of about 5.0 to 10.0 vol. % and chromium-rich carbides in an amount of about 40.0 to 45.0 vol. %, based on the total volume of the sintered powder metal composition.

The metal carbides of the sintered powder metal composition have a microscale microstructure. In one embodiment, the vanadium-rich MC carbides have a diameter of about 1 μm, and the chromium-rich $M_7C_3$ carbides have a diameter of about 1 to 2 μm. The fine carbide structure may also provide a more homogeneous microstructure. The carbides can be of various types, including $M_7C_3$, $M_8C_7$, MC, $M_4C_3$, $M_6C$, $M_{23}C_6$, $M_6C_5$, and $M_3C$, wherein M is a metal atom and C is carbon. For example, the carbides can include V-rich carbides, such as $M_8C_7$, $M_4C_3$, $M_6C_5$, Nb-rich carbides, such as MCx, where x varies from 0.75 to 0.97; or Ti and Ta-rich carbides, such as MC. The microstructure of the sintered powder metal composition also includes microscale austenite, and may include microscale martensite, along with the microscale carbides.

Table 3 includes an example of the powder metal composition prepared according to the method of the present invention, and a commercial grade of M2 tool steel for comparison.

TABLE 3

| | Compositions (in wt. %) | | | | | |
|---|---|---|---|---|---|---|
| | Cr | V | Mo | W | C | Fe |
| Inventive example | 13 | 6 | 1.5 | 2.5 | 3.8 | bal. |
| M2 | 4 | 2 | 5 | 6 | 0.85 | bal. |

The powder metal composition 18 was admixed with another powder metal and sintered. The powder metal composition was present in an amount of 20.0 wt. % and the other powder metal was present in an amount of 80.0 wt. %, based on the total weight of the admixture. The powder metal composition 18 of the sintered admixture included chromium-rich carbides in an amount of about 40-45 vol. %, and vanadium-rich carbides in an amount of about 7 vol. %, based on the total volume of the powder metal composition 18. The chromium-rich carbides had a size of about 1-2 μm and the V-rich carbides had a size of about 1 μm. The surrounding matrix of the particles in which the carbides were precipitated was essentially austenitic with some areas of martensite and ferrite.

The microhardness of the admixture after sintering was in the range of about 800 to 1,500 $Hv_{50}$. The inventive powder metal composition was admixed at 15 and 30 vol. % with a primary low carbon, low alloy powder composition. The hardness of the high carbon particles stayed above 1000 $Hv_{50}$ after compacting, sintering and tempering. Some of the carbon from the inventive composition diffused into the neighboring lower carbon content primary powder matrix material of the admix.

Controlling the sintering and tempering cycles allows one to control the properties of the primary matrix, including varying amounts of ferrite, perlite, bainite and/or martensite. Additions, such as MnS and/or other compounds may be added to the admix to alter the properties of the admix, for example to improve machinability. The inventive powder metal composition remained essentially stable and the properties essentially uninhibited by subsequent heat treatments employed to develop the properties of the primary matrix material.

The invention has been described in connection with presently preferred embodiments, and thus the description is exemplary rather than limiting in nature. Variations and modifications to the disclosed embodiment may become apparent to those skilled in the art and do come within the scope of the invention. Accordingly, the scope of invention is not to be limited to these specific embodiments.

What is claimed is:

1. A method of forming a powder metal composition, comprising the steps of:

providing a melted iron based alloy consisting of 3.8 wt. % carbon, 13.0 wt. % chromium, 2.5 wt. % tungsten, 6.0 wt. % vanadium, 1.5 wt. % molybdenum, 0.2 wt. % oxygen, 70.0 to 80.0 wt. % iron, and impurities in an amount not greater than 2.0 wt. %, based on the total weight of the melted iron based alloy; and atomizing the melted iron based alloy to provide atomized droplets of the iron based alloy; and wherein the atomized iron based alloy includes metal carbides.

2. The method of claim 1 including grinding the atomized droplets to remove an oxide skin from the atomized droplets.

3. The method of claim 1, wherein the atomizing step includes forming the metal carbides in an amount of at least 15 vol %, based on the total volume of the melted iron based alloy.

4. The method of claim 3, wherein the metal carbides are selected from the group consisting of: $M_8C_7$, $M_7C_3$, $M_6C$, wherein M is at least one metal atom and C is carbon.

5. The method of claim 4, wherein $M_8C_7$ is $(V_{63}Fe_{37})_8C_7$; $M_7C_3$ is selected from the group consisting of: $(Cr_{34}Fe_{66})_7C_3$, $Cr_{3.5}Fe_{3.5}C_3$, and $Cr_4Fe_3C_3$; and $M_6C$ is selected from the group consisting of: $Mo_3Fe_3C$, $Mo_2Fe_4C$, $W_3Fe_3C$, and $W_2Fe_4C$.

6. The method of claim 3, wherein the metal carbides include vanadium-rich carbides in an amount of about 5.0 to 10.0 vol. % and chromium-rich carbides in an amount of about 40.0 to 45.0 vol. %, based on the total volume of the melted iron based alloy.

7. A method of forming a sintered article, comprising the steps of:

providing a melted iron based alloy consisting of 3.8 wt. % carbon, 13.0 wt. % chromium, 2.5 wt. % tungsten, 6.0 wt. % vanadium, 1.5 wt. % molybdenum, 0.2 wt. % oxygen, 70.0 to 80.0 wt. % iron, and impurities in an amount not greater than 2.0 wt. %, based on the total weight of the melted iron based alloy;

atomizing the melted iron based alloy to provide atomized droplets of the iron based alloy;

optionally grinding the atomized droplets;

compacting the droplets to form a preform; and sintering the preform.

8. The method of claim 7 including annealing the droplets prior to the sintering step.

9. The method of claim 7, wherein the atomizing step includes forming metal carbides in an amount of at least 15 vol. %, based on the total volume of the melted iron based alloy.

10. The method of claim 9, wherein the metal carbides are selected from the group consisting of: $M_8C_7$, $M_7C_3$, $M_6C$, wherein M is at least one metal atom and C is carbon.

11. The method of claim 10, wherein $M_8C_7$ is $(V_{63}Fe_{37})_8C_7$; $M_7C_3$is selected from the group consisting of: $(Cr_{34}Fe_{66})_7C_3$, $Cr_{3.5}Fe_{3.5}C_3$, and $Cr_4Fe_3C_3$; and $M_6C$ is selected from the group consisting of: $Mo_3Fe_3C$, $Mo_2Fe_4C$, $W_3Fe_3C$, and $W_2Fe_4C$.

12. The method of claim 9, wherein the metal carbides include vanadium-rich carbides in an amount of about 5.0 to 10.0 vol. % and chromium-rich carbides in an amount of about 40.0 to 45.0 vol. %, based on the total volume of the melted iron based alloy.

13. The method of claim 7 including admixing at least 30.0 wt. % of an alloyed steel powder different from the iron based alloy with the atomized droplets.

* * * * *